US005615747A

United States Patent [19]

Vail, III

[11] Patent Number: 5,615,747

[45] Date of Patent: Apr. 1, 1997

[54] MONOLITHIC SELF SHARPENING ROTARY DRILL BIT HAVING TUNGSTEN CARBIDE RODS CAST IN STEEL ALLOYS

[76] Inventor: William B. Vail, III, 3123-198th Pl. SE., Bothell, Wash. 98012

[21] Appl. No.: 664,791

[22] Filed: Jun. 17, 1996

Related U.S. Application Data

[63] Continuation of Ser. No. 301,683, Sep. 7, 1994, abandoned.

[51] Int. Cl.[6] ..... E21B 10/46

[52] U.S. Cl. ..... 175/379; 175/393

[58] Field of Search ..... 175/336, 379, 175/393, 425, 428, 426, 374; 76/108.2; 51/293; 419/10

[56] References Cited

U.S. PATENT DOCUMENTS

| | | | |
|---|---|---|---|
| 4,262,761 | 4/1981 | Crow | 175/374 |
| 4,533,004 | 8/1985 | Ecer | 175/430 |
| 4,570,726 | 2/1986 | Hall | 175/426 |
| 4,593,777 | 6/1986 | Barr | 175/379 |
| 4,720,371 | 1/1988 | Shirley | 419/10 |
| 4,762,028 | 8/1988 | Regan | 76/108.2 |
| 4,844,185 | 7/1989 | Newton, Jr. et al. | 175/431 |
| 4,889,017 | 12/1989 | Fuller et al. | 76/108.2 |
| 5,061,293 | 10/1991 | Barr et al. | 51/293 |
| 5,135,061 | 8/1992 | Newton, Jr. | 175/428 |

OTHER PUBLICATIONS

Leecraft, J., "Rotary Drilling", Unit I, Lesson 2, *The Bit*, Third Edition, 1981. (Note: this is Ref. 1 in the Application and is referenced extensively in this Application.).

*Primary Examiner*—Frank Tsay

[57] ABSTRACT

A monolithic long lasting rotary drill bit for drilling a hole into a geological formation having at least one hardened rod which has a length of at least three times its diameter composed of hard material such as tungsten carbide that is cast into a relatively soft steel matrix material to make a rotary drill bit that compensates for wear on the bottom of the drill bit and that also compensates for lateral wear of the drill bit using passive, self-actuating mechanisms, triggered by bit wear to drill relatively constant diameter holes.

4 Claims, 9 Drawing Sheets

MONOLITHIC SELF SHARPENING ROTARY DRILL BIT HAVING TUNGSTEN CARBIDE RODS CAST IN STEEL ALLOYS

This application is a continuation application under 37 CFR § 1.62 of Ser. No. 08/301,683 having a filing date of Sep. 7, 1994 entitled "Monolithic Self Sharpening Rotary Drill Bit Having Tungsten Carbide Rods Cast in Steel Allows" that is abandoned.

BACKGROUND OF THE INVENTION

1. Field of the Invention

The field of invention relates to an article of manufacture that is a drill bit possessing hard abrasive rods cast into steel, such as tungsten carbide rods cast into steel, that is used to drill holes into geological formations using rotary drilling techniques typically used in the oil and gas drilling industries. The field of invention further relates to a composition of matter comprised of tungsten carbide rods cast into relatively softer bit matrix materials, such an alloy steel, to make a self-sharpening drill bit as the bit wears during drilling. The field of invention further relates to the method using the drill bit having tungsten carbide rods cast in steel to drill holes into geological formations that relies upon the progressive exposure of the tungsten carbide rods during the natural wear and erosion of the softer steel alloy matrix material in the drilling bit which results in the self-sharpening of the drill bit. The field of invention further relates to the method of making a long-lasting drill bit comprised of hard abrasive rods cast into steel that is self-sharpening upon the wear of the drill bit during drilling operations. The field of invention further relates to the method of making a long-lasting drill bit by pre-stressing mechanical elements comprising the drill bit that results in the expansion of the drill bit at its bottom during wear of the drill bit thereby producing a constant diameter hole as the bit wears. The field of invention further relates to a method of making the self-sharpening drill bit that relies upon using hardened metal scrapers that become exposed as the bit undergoes lateral wear which tend to produce a constant diameter hole as the bit wears. And finally, the field of invention relates to a method of making the self-sharpening drill bit that relies upon the lateral drill bit wear to uncover and expose new mud channels that results in lateral mud flow which in turn tends to produce a constant diameter hole as the bit undergoes lateral wear.

2. Description of Prior Art

At the time of the filing of the application herein, the applicant is unaware of any prior art that is relevant to the invention.

SUMMARY OF THE INVENTION

The rotary drilling industry presently uses the following types of drill bits that are listed in sequence of their relative importance: roller cone bits; diamond bits; and drag bits (please refer to page 1 of the book entitled "The Bit", Unit 1, Lesson 2, of the "Rotary Drilling Series", Third Edition, published by the Petroleum Extension Service, Division of Continuing Education, The University of Texas at Austin, Austin, Tex., hereinafter defined as "Ref. 1").

The early types of roller cone bits were steel-toothed (milled) bits that are still in general use today (Ref. 1, FIG. 7). The longest lasting generally available variety of roller cone bits are presently the tungsten carbide insert roller cone bits that have sealed, pressure compensated, bearings. Small tungsten carbide inserts are embedded in the rollers that are used to scrape and fracture the formation while the bit rotates under load. However, there are a large number of rapidly moving parts in a tungsten carbide insert roller cone bit, including the bearings, which make it relatively expensive and prone to eventual failure. Further, the small tungsten carbide inserts in such bits eventually tend to fall out of the cones into the well that results in the failure of the bits (Ref. 1, page 21).

Under ideal operational conditions, the diamond bits can last the longest downhole (Ref 1, page 27). Even though the diamond bits can wear, they have no rapidly moving parts such as bearings, ie., they are "monolithic". For the purposes of this application the definition of "monolithic" shall be defined to be a one piece item that has no rapidly moving parts. (For the purposes herein, the very slow deformation of mechanical parts due to interior stresses or due to mechanical wear shall not classify the part as a "moving part".) Monolithic structure is a considerable design advantage over the tungsten carbide insert roller cone type bits which have many rapidly moving parts. However, a diamond bit costs 3 to 4 times as much as an equivalent tungsten carbide insert roller cone bit (Ref. 1, page 27). The expense of the diamond bits are a major disadvantage to their routine use.

The earliest drill bits were a form of drag bit (Ref. 1, page 35). Some modern drag bits have replaceable blades. These bits have no moving parts and are relatively inexpensive.

All of the above drill bit designs provide for circulation of the mud from the drill string through the drill bit and into the well. Roller cone bits have drilled watercourses in a "regular bit" and fluid passageways in a "jet bit" (Ref. 1, pages 3–4). Diamond bits have typically "cross-pad" or "radial flow" watercourses (Ref. 1, pages 27–29). Drag bits can have a modified "jet bit" type watercourse (Ref. 1, page 36).

When any of the present drill bits are brand new and unused, all of the above drill bit designs provide various methods to minimize "undergauging" wherein a smaller hole is drilled than is desired (Ref. 1, page 19). Sending a fresh bit into an undergauged hole can result in "jamming" or other significant problems (Ref. 1, page 1). When the bits are new, all of the various designs provide a relatively controlled inside diameter of the well and also prevent the tool from being stuck or "jammed" in the well. The outer teeth on the cones of a roller cone drill bit ("gauge teeth" or "gauge cutters") determine the inside diameter of the hole and prevent sticking or jamming of the bit (Ref. 1, pages 8 and 19). The oversize lower portion of the diamond bit determines the inside diameter of the hole and prevents sticking or jamming of the bit. The lower flared taper on the drag bits determine the inside diameter of the hole and prevents sticking or jamming of the bit.

However, as any well is drilled, the roller cone bits, the diamond bits, and the drag bits undergo wear towards the ends of the bit. In this application, the definition of "longitudinal" shall mean along the axis of the bit—ie, in the direction of hole being drilled at any instant. Therefore, the roller cone bits, the diamond bits, and the drag bits all undergo longitudinal wear during drilling operations. As the bit undergoes progressive longitudinal wear, the drill bit becomes dull, and the drilling rate of penetration (feet per hour) slows. The bit can undergo wear to the point that it ultimately fails. Put simply, the roller cone bits, the diamond bits, and the drag bits become progressively duller and wear-out during drilling. The drilling industry instead desires long-lasting, self-sharpening drill bits. In this application the definition of "long-lasting" shall mean a drill bit that tends to self-sharpen under use. In this application, the definition of self-sharpen shall mean any drill bit that tends to compensate for longitudinal wear during drilling operations. The roller cone bits, the diamond bits, and the drag bits do not provide intrinsic self correcting means to produce a self-sharpening drill bit as the drill bit undergoes wear. The definition of the term "longitudinal compensation means" shall mean any means that tends to produce a self-sharpening bit as the bit undergoes longitudinal wear. Put simply, the roller cone drill bits, the diamond drill bits, and the drag bits do not provide longitudinal compensation means to compensate for the longitudinal wear of the drill bit during drilling operations.

As any well is drilled, the roller cone bits, the diamond bits, and the drag bits undergo wear on the sides of the bits. In this application, the definition of lateral shall mean the "side of" the bit—ie, in a plane perpendicular to the direction of hole being drilled at any instant. Therefore, the roller cone bits, the diamond bits, and the drag bits all undergo lateral wear during drilling operations. As a roller cone bit, diamond bit, or drag bit undergoes progressive lateral wear, the bit drills a tapered hole that is undesirable in the industry. The industry instead desires a "constant diameter hole" or constant "gauge" hole. In this application, the definition of "gauge" shall mean the inside diameter of the hole. The roller cone bits, the diamond bits, and the drag bits do not provide intrinsic self correcting means to produce a constant diameter or gauge hole as the bit undergoes lateral wear. The definition of the term "lateral compensation means" shall mean any means that tends to produce a constant diameter or gauge hole as the bit undergoes lateral wear. Put simply, the roller cone drill bits, the diamond drill bits, and the drag bits do not provide lateral compensation means to compensate for the lateral wear of the drill bit during drilling operations.

All the various different types of commercially available bits described above wear during drilling activities. All other parameters held constant, as the bits wear during drilling, the worn bits tend to slow the drilling process and the worn bits produce a smaller diameter hole as the bits wear. The industry would prefer a bit that does not become dull with use—ie, that "self-sharpens" during drilling. The industry would prefer a bit that produces a constant gauge hole during drilling in spite of any wear on the bit. This application addresses the industry needs for a self-sharpening drill bit that drills relatively constant gauge holes.

An article of manufacture is described herein that combines many advantages of the above basic three types of drilling bits into one new type of drilling bit. The new bit is a one-piece monolithic structure that has no rapidly moving parts that therefore has the inherent advantages of the diamond bit and of the drag bit. The new bit uses individual tungsten carbide rods cast into steel which provides some of the bottom cutting action of the bit. Such a bit has the cost advantage of tungsten carbide insert roller cone bits in that relatively inexpensive tungsten carbide materials are used for fabrication of the new bit instead of expensive diamonds. Further, the long tungsten rods tend not to fall out of the new drill bit whereas the diamonds can fall out of the diamond bit (Ref. 1 page 35) and the tungsten carbide inserts can fall out of the tungsten carbide insert roller cones (Ref. 1, page 21). Lost tungsten carbide inserts can cause great difficulties during the drilling process (Ref. 1, page 21). Lost diamonds from a diamond bit can cause great problems during drilling (Ref. 1, page 35). Therefore, the fact that the relatively long tungsten carbide rods in the preferred embodiments of the invention herein tend not to become dislodged and tend not to become lost in the well is of considerable economic importance.

The tungsten carbide rods become gradually and progressively exposed on the bottom of the bit as the drill bit wears while drilling the well thereby providing a self-sharpening of the drill bit. The bit wears under the separate influences of the abrasive rock present and the abrasive nature of drilling mud or other drilling fluids. The tungsten carbide rods are eroded at a slower rate than the alloy steel in which it is cast. Broken ends of the tungsten carbide rods can actually speed the drilling process iN analogy with certain phenomena observed with tungsten carbide insert roller cone bits (Ref. 1, page 20). Several hardened metal scrapers are also cast into the sides of the new bit that act analogously to the blades of a drag bit which provide some of the wall cutting action. As the steel alloy matrix material of the bit erodes, these hardened metal scrapers become progressively more exposed that results in self-sharpening of the bit.

It is also desirable that the bit produce a constant gauge hole as the bit wears. The various embodiments of the invention disclose different methods to accomplish this goal. However, all the different methods rely upon the wear of the bit during drilling to cause physical changes in the drill bit that result in the compensation for lateral bit wear.

A first class of preferred embodiments of the new bit provide for pre-stressed mechanical elements welded together to form the monolithic drill bit which naturally expand radially upon wearing of the welds on the bottom of the new bit resulting in a lower flair, or "bell shape", of the new bit that in turn determines the inside diameter of the well and that prevents sticking of the bit in the well. The rods facing downward in the first class of preferred embodiments provide compensation for longitudinal bit wear and the lower flair provides compensation for lateral bit wear. A second class of preferred embodiments of the new bit provide a single cast unit having tungsten carbide rods, no welds, but extra lateral hardened metal scrapers to compensate for lateral bit wear. A third class of preferred embodiments of the invention provide a single cast unit having tungsten carbide rods, few welds, but that are heat treated so that the bottom of the bit naturally radially expands upon wear that provides compensation for lateral bit wear to provide a relatively constant gauge hole during drilling. A fourth class of preferred embodiments of the invention provide a single cast unit having tungsten carbide rods, few welds, that has relatively lateral facing hardened metal scrapers that become exposed during the natural wear of the bit which tend to produce a constant gauge hole as the bit undergoes lateral wear. A fifth class of preferred embodiments of the invention provides a single cast unit having tungsten carbide rods, few welds, that possess additional mud cavities that upon the natural wear of the bit, open to the well, causing lateral mud flow that produces a relatively constant gauge hole as the bits undergo lateral wear.

The new bit has watercourses similar to those of a diamond bit. The bit herein uses alternatively "cross-pad flow" or "radial flow" type watercourses discussed earlier.

The fact that the new drill bit can have a large length over diameter ratio, self-sharpens, and produces a relatively constant gauge hole as the bit wears results in a long-lasting drill bit that is of considerable importance to the drilling industry.

Accordingly, an object of the invention is to provide new articles of manufacture that are drill bits used to drill holes into the earth.

It is another object of the invention to provide new articles of manufacture that are drill bits which use tungsten carbide rods cast into steel to produce long-lasting self-sharpening drill bits.

It is yet another object of the invention to provide pre-stressed mechanical elements welded together to form a monolithic drill bit which expand radially in the well producing a flair on the bottom of the bit that determines the inside diameter of the well and that is used to prevent jamming of the bit in the well.

It is another object of the invention to provide a new composition of matter comprised of tungsten carbide rods cast into alloy steel to form a drill bit.

Further, it is another object of the invention to provide new methods of using the drill bit comprised of tungsten carbide rods cast into steel that results in a self-sharpening of the drill bit while the hole is being drilled.

It is yet another object of the invention to provide a method to manufacture long lasting drill bits by casting relatively hard rods into matrix materials such as by casting tungsten carbide rods into alloys of steel.

It is another object of the invention to provide a new composition of matter comprised of tungsten carbide rods cast into steel to form a drill bit that is heat treated to form a monolithic drill bit which, upon wear, naturally expands radially in the well producing a flair on the bottom of the bit that determines the inside of the well and that is used to prevent jamming of the bit in the well.

It is yet another object of the invention to provide a single cast drill having tungsten carbide rods cast into steel alloy matrix material, few welds, that has relatively lateral facing hardened metal scrapers that progressively become exposed during the wear of the bit that tend to produce a constant gauge hole as the bit undergoes lateral wear.

It is another object of the invention to provide a single cast drill bit having tungsten carbide rods cast into steel alloy matrix material, few welds, that possesses cavities which upon wear of the bit, open to the well, causing lateral mud flow into the well which in turn produce a constant gauge hole as the bit undergo lateral bit wear.

It is also another object of the invention to provide a monolithic self-sharpening, long lasting, rotary drill bit having longitudinal compensation means to compensate for the longitudinal wear of the drill bit during drilling operations.

And it is finally another object of the invention to provide a monolithic rotary drill bit having lateral compensation means to compensate for the lateral wear of the drill bit to provide a bit capable of drilling relatively constant gauge holes during drilling operations.

DESCRIPTION OF THE PREFERRED EMBODIMENTS

Figure 1:
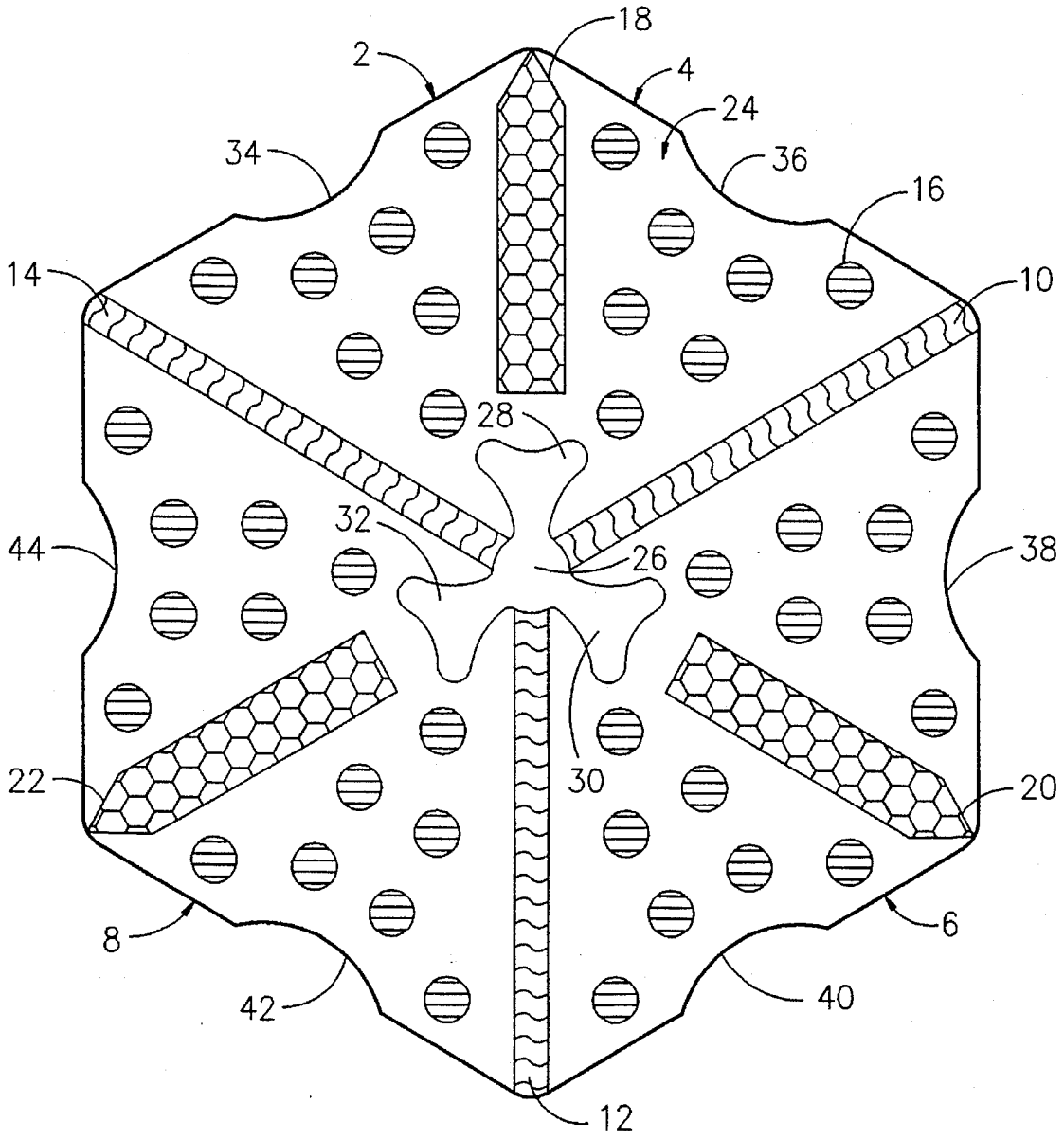
FIG. 1 is a bottom view of a monolithic self sharpening rotary drill bit having three each welded mechanically pre-stressed metal components comprised of material having tungsten carbide rods and a hardened metal scraper embedded in steel.

FIG. 1 is a bottom view of a preferred embodiment of the invention that is a monolithic self sharpening rotary drill bit having three each welded mechanically pre-stressed metal components comprised of material having tungsten carbide rods and a hardened metal scraper embedded in steel. The assembled drill bit 2 is comprised of the first, second, and third each separate mechanically pre-stressed metal components labeled respectively as elements 4, 6, and 8 in FIG. 1. The three each separate mechanically pre-stressed metal components are welded together respectively by welds 10, 12, and 14. A typical tungsten carbide rod 16 (viewed end-on) is embedded within steel in metal component 4. Similarly, tungsten carbide rods are embedded in steel in the other metal components 6 and 8 that have similar shading shown in FIG. 1. A hardened metal scraper 18 is embedded in steel within metal component 4; a hardened metal scraper 20 is embedded in steel within metal component 6; and a hardened metal scraper 22 is embedded in steel within metal component 8. The steel alloy matrix material in which the tungsten carbide rod 16 and the hardened metal scraper 18 are embedded in metal component 4 is labeled as element 24 in FIG. 1. The tungsten carbide rods and the hardened metal scrapers of metal components 6 and 8 are also similarly embedded into steel. A radial flow watercourse is comprised of central hole 26 and waterpassages 28, 30, and 32 respectively in metal components 4, 6, and 8. Junk slots 34 and 36 have been fabricated into first metal component 4. Junk slots 38 and 40 have been fabricated into second metal component 6. Junk slots 42 and 44 have been fabricated into third metal component 8.

Figure 2:
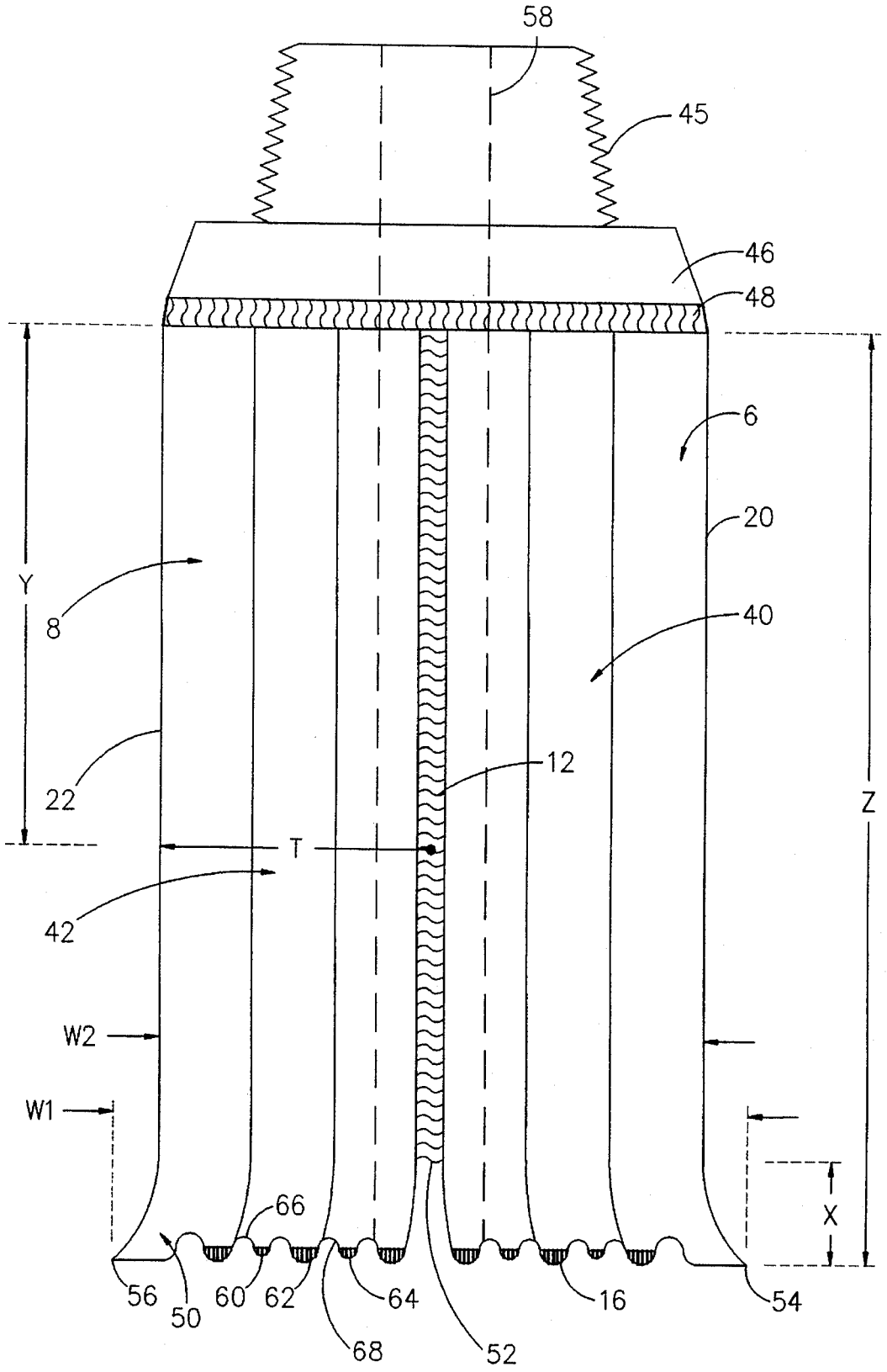
FIG. 2 is a side view of a monolithic self sharpening rotary drill bit having three each welded mechanically pre-stressed metal components comprised of material having tungsten carbide rods and a hardened metal scraper embedded in steel.

FIG. 2 is a side view of the monolithic self sharpening rotary drill bit described in FIG. 1. Elements 6, 8, 12, 16, 20, 22, 40, and 42 have already been defined above and are shown in FIG. 2 for illustrative purposes. A side view of metal component 6 is shown on the right-hand side of FIG. 2. A side view of metal component 8 is shown on the left-hand side of FIG. 2. Metal components 6 and 8 are jointed with weld 12. The leading edge of hardened metal scraper 20 in metal component 6 is identified in FIG. 2. The leading edge of hardened metal scraper 22 in metal component 8 is identified in FIG. 2. Junk slot 40 in metal component 6 and junk slot 42 in metal component 8 are identified in FIG. 2. The bottom of tungsten carbide rod 16 is shown emerging from the bottom of the drill bit in FIG. 2 that is darkly shaded in that figure. Bit shank 45 (also called the "pin") has the usual mechanical threads appropriate to be screwed into the drill collar (please refer to the section entitled "Tool Joints" beginning on page 9 of the book entitled "The Drill stem", Unit 1, Lesson 3, of the "Rotary Drilling Series", Second Edition, published by the Petroleum Extension Service, Division of Continuing Education, The University of Texas at Austin, Austin, Tex., hereinafter defined as "Ref. 2"). For the application herein, the Glossary of Ref. 2 defines several terms as follows. The "drill collar" is "a heavy, thick-walled tube, usually steel, used between the drill pipe and the bit in the drill stem . . . " The "drill stem" is comprised of "all members in the assembly used for drilling by the rotary method from the swivel to the bit, including the kelly, drill pipe and tool joints, drill collars, stabilizers and various specialty items." The "drill string" is "the column, or string, or drill pipe with attached tool joints that transmits fluid and rotational power from the kelly to the drill collars and bit." Bit shank 45 and bit shank support 46 are manufactured from one piece of steel. The bottom portion of the bit shank support 46 is welded to the top portions of metal components 4, 6, and 8 by weld 48. After welds 48, 12, 14, and 16 have been completed, the drill bit is then in one-piece, or is a "monolithic drill bit". The construction of the bit as defined in FIGS. 1 and 2 results in a "flared" or "bell shaped" bottom of the bit in the region labeled as element 50 in FIG. 2.

In FIG. 2, the bottom of weld 12 is labeled as element 52. As the bit wears due to the abrasiveness of the rock and under the influence of the erosion of the drilling mud, the position of weld 52 moves vertically upward in the drill bit from the bottom of the drill bit by the distance labeled with legend "X" in FIG. 2. (Here, the "bottom of the drill bit" means the hypothetical plane that "best fits" the "average position" of the tungsten carbide rods and steel emerging from the bottom of the bit, which may or may not be planar.) The distance from the bottom of weld 48 to the bottom of the drill bit is identified by the legend Z in FIG. 2. When the drill bit is new, the distance Z=L, where L is the original length of the new drill bit. Therefore, Z is the usable length of the drill bit remaining after longitudinal wear. FIG. 2 shows the extreme flared position of hardened metal scraper 20 at the bottom of the drill bit and that extreme position is labeled as element 54. FIG. 2 shows the extreme flared position of hardened metal scraper 22 at the bottom of the drill bit and that extreme position is labeled element 56. The width between the extreme positions 54 and 56 is labeled with legend W1 that establishes one limitation on the minimum inside diameter of the hole. The width between hardened metal scrapers 20 and 22 in a standard, non-flared, portion of the drill bit is labeled with legend W2 in FIG. 2. The inside diameter of the hole is only indirectly related to the dimensions W1 and W2. A geometric parameter better related to the dimensions of the hole to be drilled is the vector radius that points to the outer portion of the drill bit at a given azimuthal direction with respect to the axis of the drill bit, and that radius is labeled with legend T in FIG. 2. The "magnitude of that vector radius T" is the distance in any one chosen direction from the center of the drill bit to the outer edge of the drill bit in that particular chosen direction. Various radii may be measured in different azimuthal directions such as T1, T2, T3, etc. Those radii are measured at a distance from the bottom of weld 48 and that distance is labeled with legend Y in FIG. 2. Different particular positions of Y may be specified respectively identified as Y1, Y2, Y3, etc.

In FIG. 2, the position of the watercourse through the interior of the drill bit is figuratively identified by dashed line 58. Various different tungsten carbide rods 60, 62, and 64 are shown protruding below the steel alloy matrix of the tool bit that are shaded solid for clarity. The positions of the steel alloy matrix material between the three previously identified tungsten carbide rods are labeled respectively as elements 66 and 68 in FIG. 2.

Figure 3:
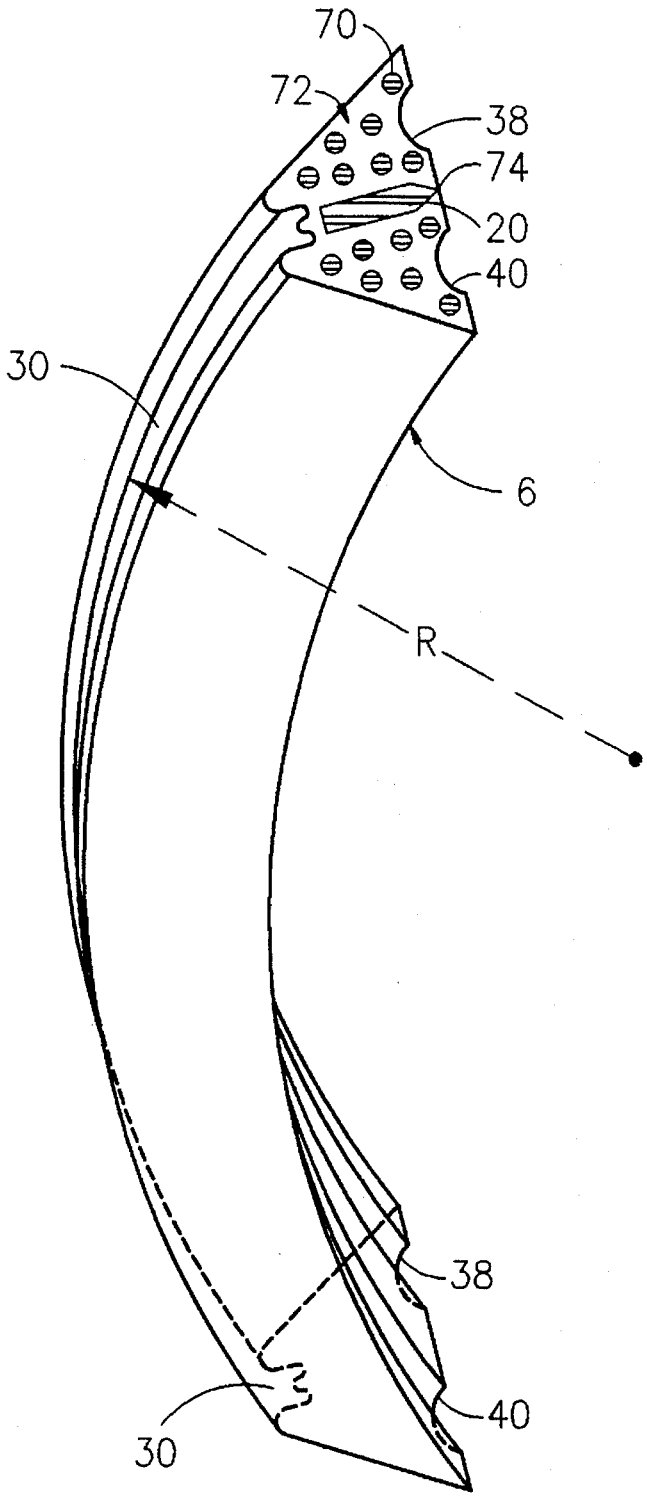
FIG. 3 is a perspective view of one of the components comprised of material having tungsten carbide rods and a hardened metal scraper embedded in steel before the component is assembled and welded in place into the drill bit shown in FIGS. 1 and 2.

FIG. 3 is a perspective view of metal component 6 before weldment into the drill bit shown in FIGS. 1 and 2. Junk slots 38 and 40 are shown at several positions on metal component 6 for illustrative purposes. Watercourse passage 30 is repetitively shown at several positions along metal component 6 for illustrative purposes. Hardened metal scraper 20 is identified in FIG. 3. A tungsten carbide rod 70 is identified that is located within the steel alloy matrix 72 of metal component 6. Metal component 6 is fabricated having an arc shape using various possible processes. The arc shaped component 6 and the orientation of the arc is specified by the radius identified in FIG. 3 with the legend "R". The radius R is contained in the hypothetical geometric plane having the watercourse passage 30 and the line along the tip of the hardened metal scraper 20, where that line is identified as element 74 in FIG. 3. The arc shaped component 6 can be directly cast in this form. Alternatively, component 6 can be cast having an initially straight form, which can thereafter be bent under stress into the desired arc shape. Numerous other fabrication techniques can produce metal component 6 with the suitable arc shape shown in FIG. 3.

Figure 4:
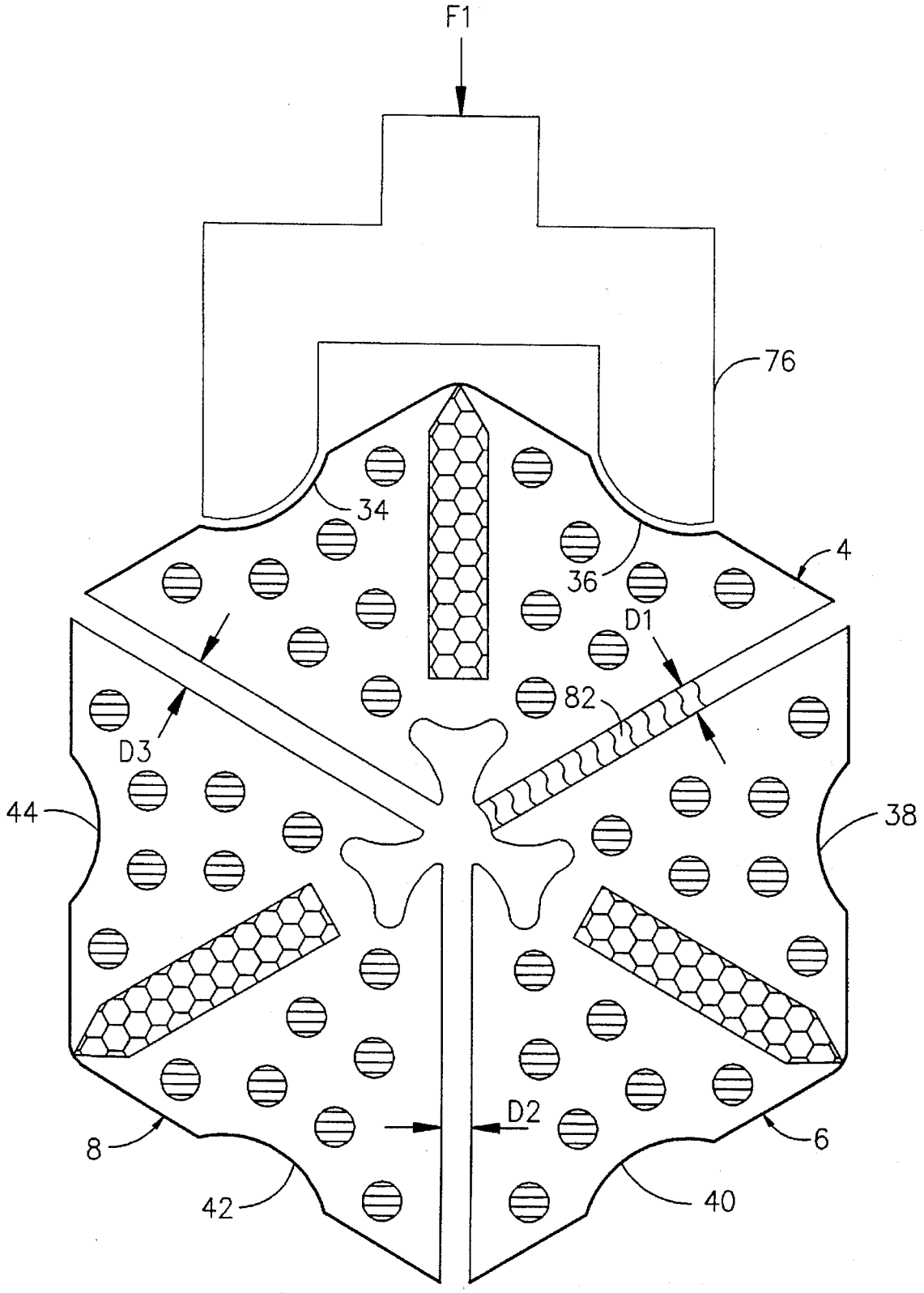
FIG. 4 is a bottom view of three each of the mechanically pre-stressed welded steel components during assembly that are held in place and which are subjected to mechanical stress during the fabrication process of the drill bit shown in FIGS. 1 and 2.

FIG. 4 is a bottom view of a particular cross section of the drill bit at one stage of the fabrication process at a particular chosen value of Y. Three each of the mechanically prestressed welded steel components are held in place and are subjected to mechanical stress during the fabrication process of the drill bit shown in FIGS. 1, 2, and 3. Here, metal components 4, 6, and 8 are held in place for welding a portion of the assembly. Guide 76 holds metal component 4 in place with a force labeled with legend F1 in FIG. 4. The force F1 from guide 76 is transmitted to junk slots 34 and 36. At this stage of assembly, bit shank 45 and bit shank support 46 are held in place with a vise or clamp during assembly, although that vise is not shown in FIG. 4. Other guides holding the assembly in place for welding are not shown for simplicity. Not shown is guide 78 that holds metal component 6 in place with a force F2 applied to junk slots 38 and 40; and similarly, not shown is guide 80 that holds metal component 8 in place with a force F3 applied to junk slots 42 and 44.

Several steps in the fabrication of the drill bit shown in FIG. 4 have already been completed. Weld 48 has been completely finished prior to the fabrication step shown in FIG. 4. Initially, metal component 6 as shown in FIG. 3, and similarly shaped metal components 4 and 8, are welded in their final orientations at their attachment to bit shank support 46 by weld 48. Metal components 4, 6, and 8 at that stage of fabrication will be separated at the bottom of the bit because each of those parts have their respective radii R. However, a jig having guides 76, 78, and 80 respectively force metal components 4, 6, and 8 in place so that portions of welds 10, 12, and 14 can be made sequentially. Element 82 in FIG. 4 points to a portion of weld 10 during the process of fabrication shown in FIG. 4. At this particular position Y1 along the length of the drill bit, guides 76, 78, and 80 positively force metal components 4, 6, and 8 in place for weldment. At this position Y1, the distance of separation between metal components 4 and 6 is labeled with legend D1 in FIG. 4; the distance of separation between metal components 6 and 8 is labeled with legend D2 in FIG. 4; and the distance of separation between metal components 8 and 4 is labeled with legend D3 in FIG. 4. Prior to weldment of the drill bit at position Y1, the forces F1, F2, and F3 are adjusted until the distances D1, D2, and D3 all become approximately equal to D(AVERAGE). Thereafter, a bead-weld is made joining metal components 4, 6, and 8 at position Y1. This process is repeated for various different positions Y2, Y3, etc., until the monolithic drill bit is welded together.

By the time that welds 10, 12, and 14 in FIG. 1 are completed, metal components 4, 6, and 8 are under considerable stress. This preferred embodiment of the invention provides pre-stressed mechanical elements welded together to form a monolithic drill bit that expands radially in the well producing a flair on the bottom of the bit. That flair determines the inside diameter of the well and is used to prevent jamming of the bit in the well. The welds 4, 6, and 12 tend to hold the bottom of the drill bit in line. Wearing those welds allows the bottom of the tool bit to expand as shown in FIG. 2. The fact that as the welds wear, that the bottom of the tool bit automatically flares outward radially in the well is an example of a lateral compensation means to compensate for lateral wear of the drill bit during drilling operations.

Therefore, FIGS. 1, 2, 3, and 4 describe a preferred embodiment of the invention that is a monolithic drill bit possessing lateral compensation means to compensate for lateral wear of the drill bit during drilling operations so that the drill bit makes a relatively constant gauge hole as the bit undergoes lateral wear.

As the bit rotates under weight, the relatively soft steel alloy matrix material surrounding the tungsten carbide rods wears away. Therefore, the continual erosion of the relatively soft steel alloy matrix results in the progressive uncovering of the rods resulting in the appearance of the bottom of the tool bit as shown in FIG. 2. Such erosion of steel surrounding the tungsten carbide inserts of the tungsten carbide insert roller cone bits is known to naturally occur during drilling with such bits (Ref. 1, page 21). The bit described herein will undergo similar wear. Until the length Z becomes very small, there is a continuous supply of tungsten carbide rods sticking out the bottom of the tool bit that drills the well. As the tungsten carbide rods dull, or their ends break off, more will become available as the steel alloy matrix material naturally wears away. The process of the gradual wearing of the steel alloy matrix material that exposes additional portions of the tungsten carbide rods is an example of a longitudinal compensation means that compensates for the longitudinal wear of the drill bit during drilling operations.

Therefore, FIGS. 1, 2, 3, and 4 describe a preferred embodiment of the invention that is a monolithic rotary drill bit having longitudinal compensation means to compensate for the longitudinal wear of the drill bit during drilling operations.

The cutting action of this type of bit provides cutting action similar to that provided by a diamond bit. Diamond bits provide the following three types of basic cutting actions: compressive action; abrasive action; and plowing action (Ref. 1, page 33). In compressive action, the exposed tungsten carbide rods create stresses that result in the fracturing of the rock. In abrasive action, the exposed tungsten carbide rods and the relatively softer steel alloy matrix material simply grind through the formation. In plowing action, the exposed tungsten carbide rods actually penetrate the formation and the formation is gouged out in front of the penetrating tungsten carbide rods as the bit rotates. In all cases, the rock fragments will be carried away by the action of the mud flow.

Hardened metal scrapers 18, 20, and 22 act like the blades of modern drag bits when the bit is under load. The "flared" or "bell shaped" bottom region of the bit is labeled as element 50 in FIG. 2. That "flared" or "bell shaped" region acts like the lower flared taper on some modern drag bits. That flared taper determines the inside diameter of the hole and prevents the sticking or jamming of the bit. Therefore, this method of operation of the bit results in a flared portion of the bit that prevents "undergauging" of the hole which can result in jamming of the bit. This flared portion of the preferred embodiment of the invention provides the analogous function to that provided by the oversize lower portion of a diamond bit which, by design, is used to prevent jamming (See FIGS. 37, 38, and 39 in Ref. 1). Therefore, the hardened metal scrapers 18, 20, and 22 acting on the walls of the well determine the minimum inside diameter of the hole. The sharp edges of the hardened metal scrapers 18, 20, and 22 become progressively more available to abrade the wall of the well as the steel alloy matrix material of the bit erodes. This process of additional exposure of the hardened metal scrapers provides additional lateral compensation means to compensate for lateral bit wear during drilling operations.

The portions of hardened metal scrapers facing down in the well also play a role in drilling the well at the bottom of the bit. Modern day drag bits have portions of their blades facing downward to the hole (See FIGS. 45 and 46 in Ref. 1). The portions of hardened metal scrapers 18, 20, and 22 that face downward functionally act similarly to the downward facing blades of drag bits. The exposed portions of these hardened metal scrapers facing downward provide additional longitudinal compensation means to compensate for longitudinal bit wear.

Therefore, FIGS. 1, 2, 3, and 4 describe a monolithic rotary drill bit having longitudinal compensation means to compensate for the longitudinal wear of the drill bit during drilling operations. FIGS. 1, 2, 3, and 4 further describe a monolithic drill bit possessing lateral compensation means to compensate for lateral wear of the drill bit during drilling operations.

Figure 5:
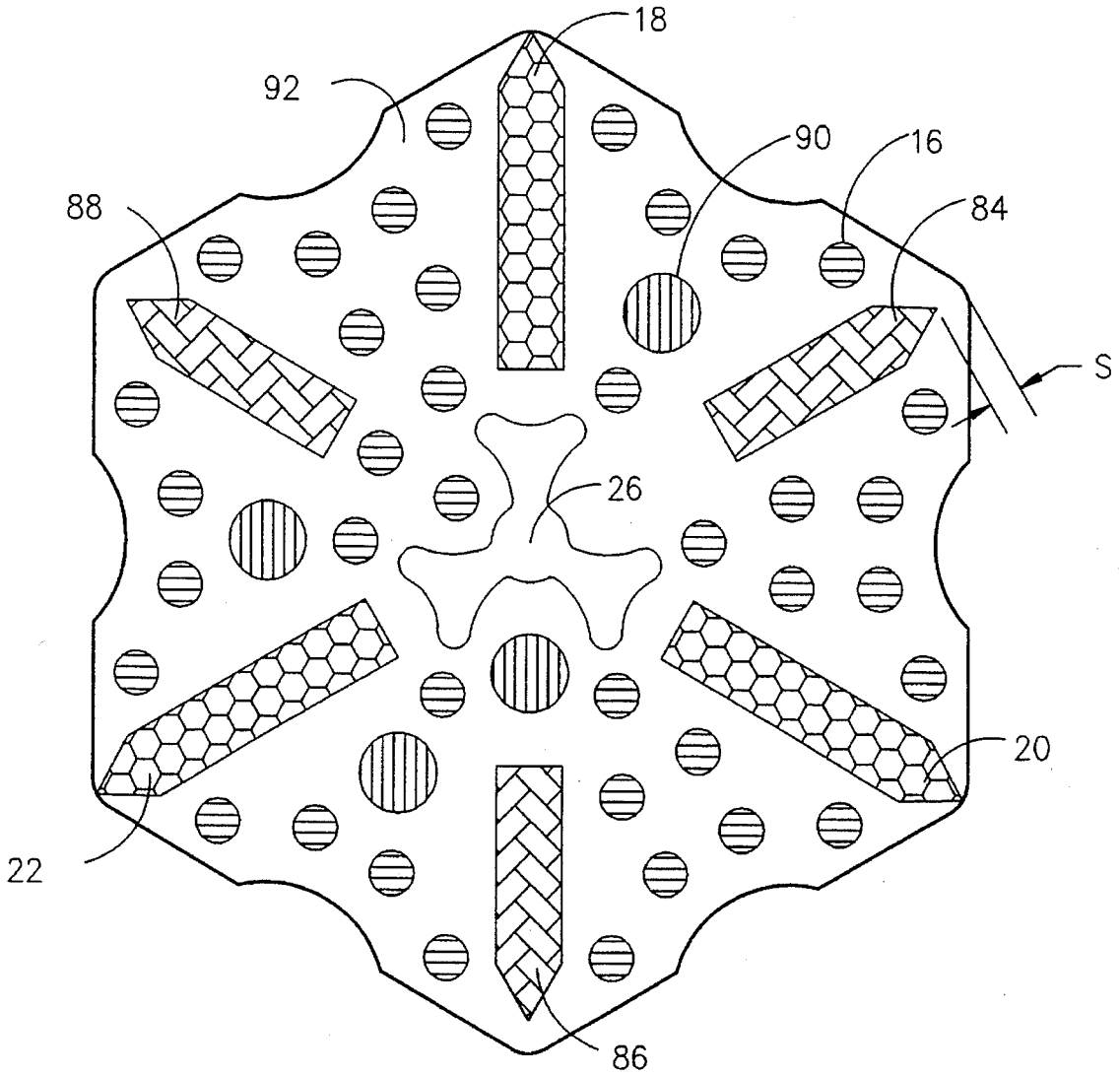
FIG. 5 is a bottom view of another monolithic self sharpening rotary drill bit that is comprised of tungsten carbide rods and a total of 6 hardened metal scrapers that are embedded into steel as one solid unit during the fabrication process.

FIG. 5 shows a bottom view of another preferred embodiment of the invention. It is similar to the invention described in FIGS. 1 through 4. However, here there are no analogous welds 10, 12, 14 or 48. Instead, a bit looking similar to the side view in FIG. 2 is cast in one piece and the threads fabricated on the top of the bit thereafter. Tungsten carbide rod 16; hardened metal scrapers 18, 20, and 22; and central hole 26 of the waterpassages have already been defined. The junk slots in the bit are shown in FIG. 5 but are not numbered. Different varieties of hardened metal scrapers 84, 86, and 88 are also cast into the steel alloy matrix material. The points of the different hardened metal scrapers facing outward are set-back into the steel alloy matrix material by a distance from the lateral wall of the bit which is labeled with the legend "S" in FIG. 5. Therefore, by design, hardened metal scrapers 84, 86, and 88 do not become exposed until the bit undergoes substantial lateral bit wear. Larger tungsten carbide rods typified by the one labeled with legend 90 in FIG. 5 are also present. In this case, all of the tungsten carbide rods and hardened metal scrapers are cast at one time into steel alloy matrix material 92. The progressive exposure of the downward facing scrapers and rods as the bit undergoes longitudinal wear provide compensation for longitudinal bit wear thereby producing a long-lasting bit. The progressive exposure of extra scrapers 84, 86, and 88 after substantial lateral bit wear provides compensation for lateral bit wear that makes a substantially constant gauge hole. The invention in FIG. 5 is simpler and less expensive to fabricate than that shown in FIGS. 1–4 and therefore is of importance.

Figure 6:
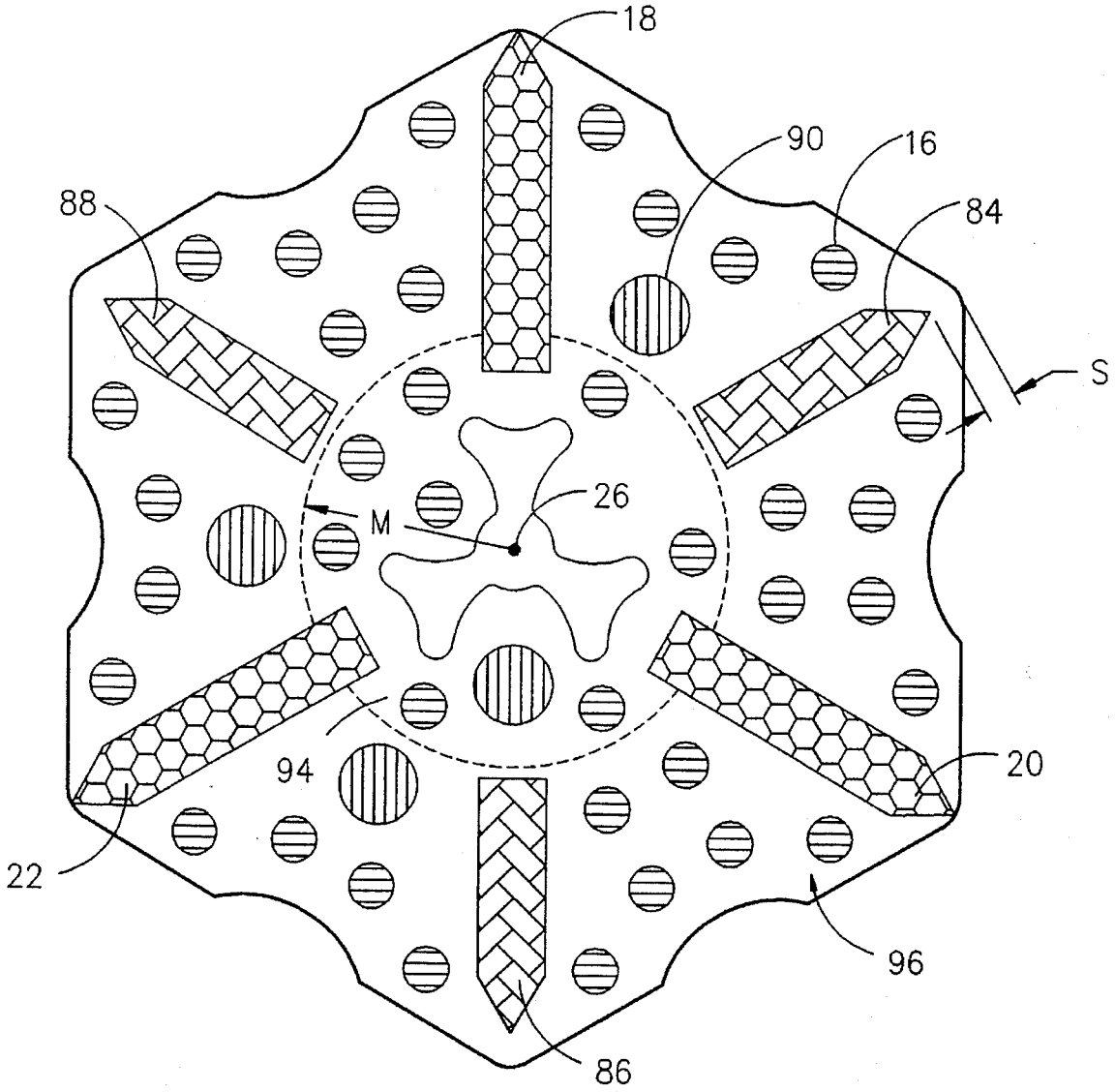
FIG. 6 is a bottom view of another monolithic self sharpening rotary drill bit that is comprised of tungsten carbide rods and a total of 6 hardened metal scrapers that are embedded into steel alloy matrix materials that has been heat treated and/or has composition variations in the steel alloy materials that produce internal lateral mechanical stresses within the drill bit.

FIG. 6 shows another preferred embodiment of the invention. Like that shown in FIG. 5, it is a monolithic bit that is cast as one unit. All of the numbered items are the same through element 90. However, the composition of steel alloy matrix materials and their heat treatments are chosen to result in internal stresses within the drill bit. Those internal stresses result in the flaring of the bottom portion of the drill bit upon wear. First steel alloy matrix material 94 is cast and heat treated with a first heat treatment to the radius labeled with legend "M" in FIG. 6. Second steel alloy matrix material 96 is then cast and heat treated with a second heat treatment from radius M to the outer lateral portions of the drill bit. The steel alloy matrix material 96 is chosen to be of higher tensile strength and more resistant to wear than steel alloy matrix material 94. The heat treatments and alloy steels are chosen such that internal stresses are built up in the drill bit pointing outward, or toward the lateral portions of the drill bit. When steel alloy matrix material 94 inside the radius M is worn away during drilling, the drill bit tends to flair outward at the bottom. The progressive exposure of extra scrapers 84, 86, and 88 after substantial lateral bit wear, and the additional flaring of the bit at its bottom after substantial lateral bit wear, provide compensation for lateral bit wear that makes a substantially constant gauge hole. The progressive exposure of downward facing scrapers and rods as the bit undergoes longitudinal bit wear provides compensation for longitudinal bit wear that provides a long-lasting bit. The bit in FIG. 6 is more complex and more expensive to fabricate than that in FIG. 5. However, the bit in FIG. 6 has extra lateral compensation for lateral bit wear and will tend to produce a more constant gauge hole than will the bit in FIG. 5.

Figure 7:
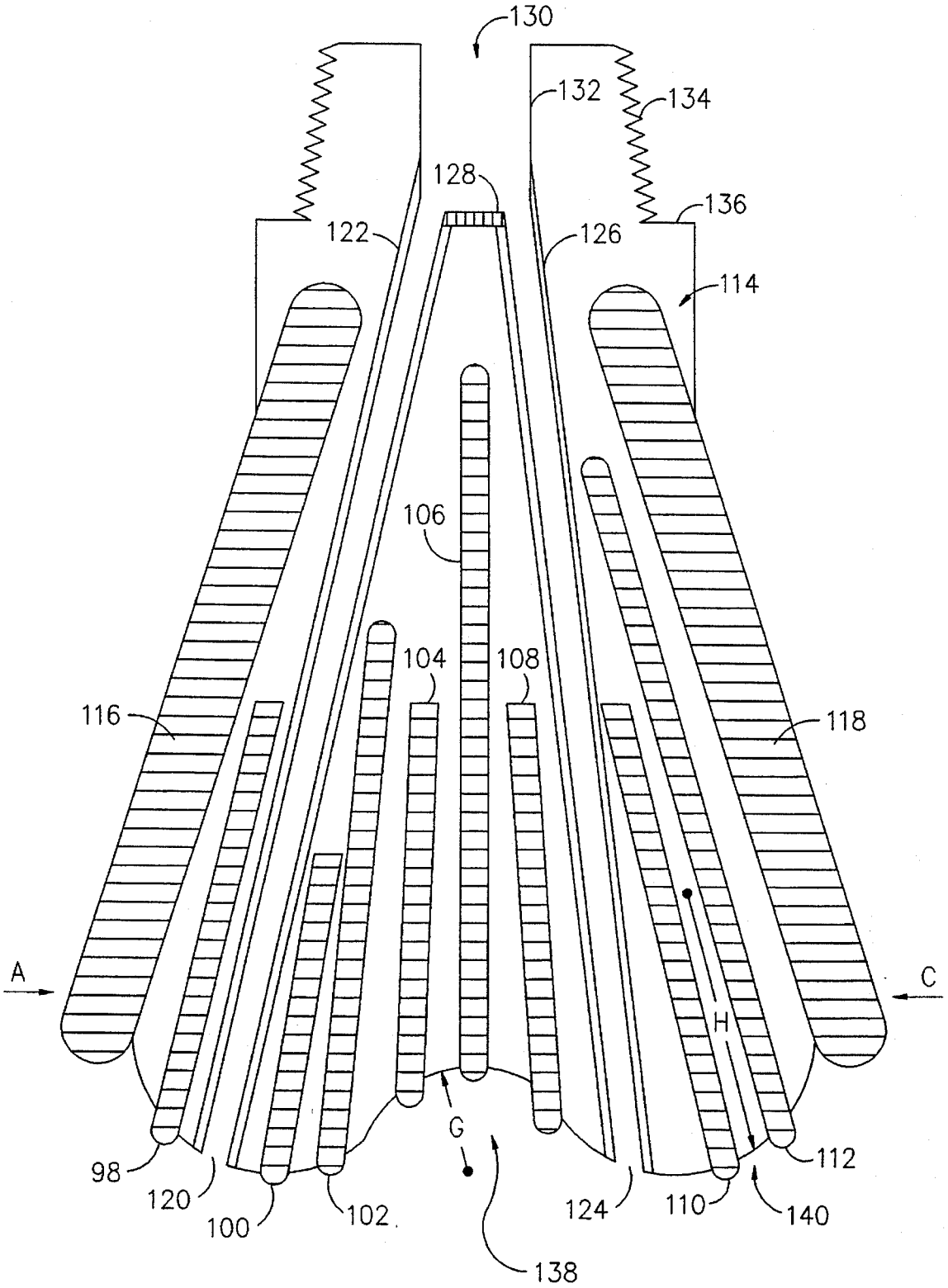
FIG. 7 is a side view of another monolithic self sharpening rotary drill bit that is comprised of tungsten carbide rods, hardened metal scrapers, and other materials that are embedded into steel alloy matrix material that provides compensation for longitudinal bit wear and compensation for lateral bit wear.
Figure 9:
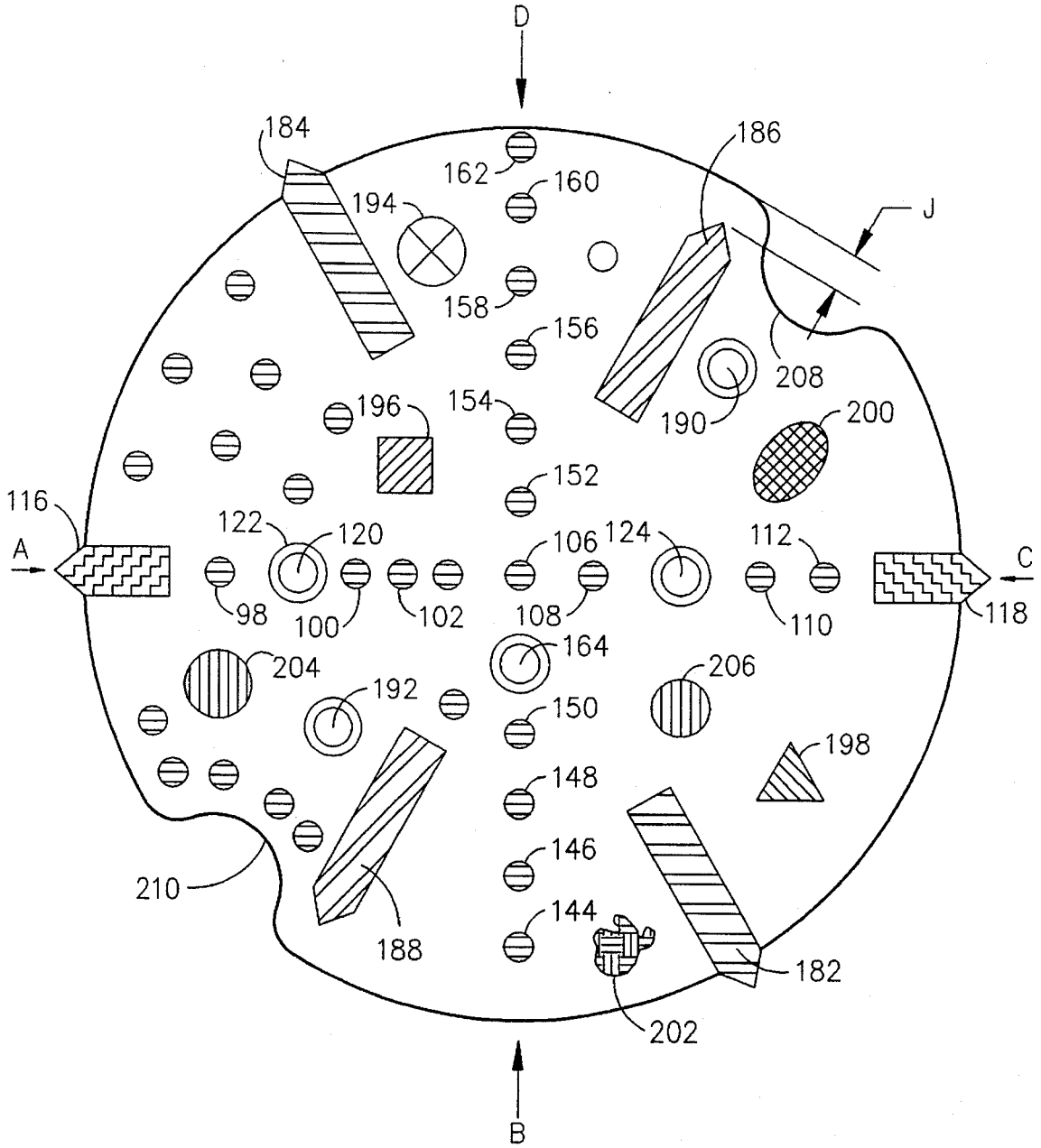
FIG. 9 is the bottom view of the drill bit corresponding to FIGS. 7 and 8 that shows various tungsten carbide rods cast in steel alloy matrix material, hardened metal scrapers that become exposed during bit wear, and a longitudinal mud flow compensation channel.

FIG. 7 shows a cross sectional view of another preferred embodiment of the invention that is a monolithic rotary dill bit. The cross sectional view is identified with legends "A" and "C" that are shown in FIG. 9. Tungsten carbide rods 98, 100, 102, 104, 106, 108, 110, and 112 are cast into steel alloy matrix material 114. Hardened metal scraper 116 is exposed on the left of the drill bit in FIG. 7. Hardened metal scraper 118 is exposed on the right of the drill bit in FIG. 7. Watercourse 120 exits at the bottom of the bit that has a mud channel encapsulated by a hardened metal tube 122 to prevent wear inside the bit due to the abrasive mud flow. Watercourse 124 exits at the bottom of the bit that has a mud channel encapsulated by hardened metal tube 126 to prevent wear inside the bit due to the abrasive mud flow. Hardened metal mud blocking part 128 is installed to prevent wear due to the mud flow through main mud flow channel 130. The following are all cast as one unit together at the same time in steel alloy matrix material 114: tungsten carbide rods 100, 102, 104, 106, 108, 110, and 112; hardened metal scrapers 116 and 118; hardened metal tubes 122 and 126; and hardened metal mud blocking part 128. Standard steel alloy casting methods are used to align the parts and to fabricate the monolithic drill bit. The wall 132 of main mud flow channel 130 does not have hardened metal tube reinforcement in FIG. 7. (However, hardened metal tube wall reinforcement to main mud flow channel 130 may be added and cast into place with the rest of the parts—although that is not shown in FIG. 7). The main mud flow channel 130 is connected to watercourse 120 and watercourse 124 and provides mud to the bottom of the bit through those watercourses and others not shown in FIG. 7. Bit shank 134 (also called the "pin") has the usual mechanical threads appropriate to be screwed into the drill collar (described in FIG. 2). Mating shoulder 136 is to "bottom-out" solidly against the drill collar. The bit shank 134 and mating shoulder 136 may be machined into the bit after casting as shown in FIG. 7. (Alternatively, bit shank 134 and mating shoulder 136 can be a separate part that is cast into place with the rest of the rods, tubes, and scrapers—although that separate part is not shown in FIG. 7 for simplicity.)

In FIG. 7, near the center of the bottom of the bit, there is an inward recession into the bit shown generally as region 138 in FIG. 7. This recession helps guide the bit in a manner similar to how a coring bit is guided by the core it makes as it travels through the rock. There is a bit guide radius, labeled with legend "G" in FIG. 7, that is the radius that best approximates the curvature present in the steel alloy of the surface defining the inward recession 138 along cross section "A"-"C". The definition of the phrase "bit guide recession" in this application shall generally refer to any inward recession present near the center of the drill bit. The lower right-hand surface of the steel alloy matrix material in exterior region 140 of the bit has portions that protrude or extend outward below than the center of the bit. This region can be specified by a lateral bit radius labeled with legend "H" in FIG. 7. Lateral bit radius H is that radius that best approximates the curvature present in the steel alloy matrix of the surface in region 140 along cross section "A"-"C". Similar comments apply to the lower left-hand side of the bit. The definition of the phrase "lateral bit protrusion" in this application shall mean a region of the bit having any outward extending portion that extends lower than the center of the bit.

Figure 8:
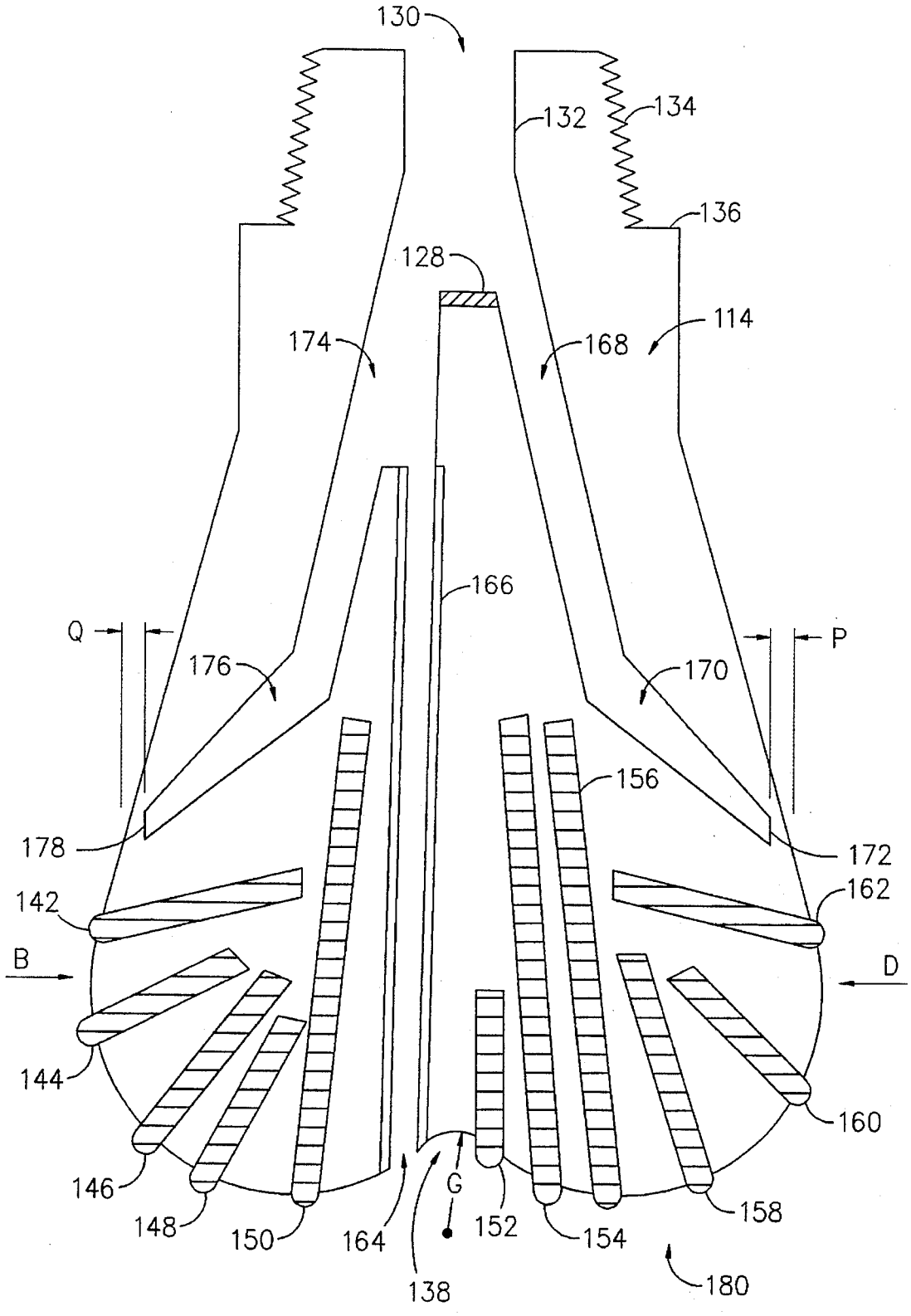
FIG. 8 is side view, rotated 90 degrees about the longitudinal axis of the drill bit, of the view shown in FIG. 7 which shows lateral mud flow compensation channels.

FIG. 8 shows another cross sectional view of of the monolithic rotary drill bit shown in FIG. 7. This cross sectional view is rotated 90 degrees (viewed from the bottom—see FIG. 9) from that shown in FIG. 7. The cross sectional view is identified with legends "B" and "D" that are shown in FIG. 9. Elements number 114, 128, 130, 132, 134, 136 and 138 have already been defined in FIG. 7. In this case, the bit guide radius G of the bit guide recession is the same along cross section "B"-"H" and along cross section "A"-"C", although this is not always necessarily true. Tungsten carbide rods 142, 144, 146, 148, 150, 152, 154, 156, 158, 160 and 162 are cast into steel alloy matrix material 114. Watercourse 164 exits at the bottom of the bit that has a mud channel encapsulated by a hardened metal tube 166 to prevent wear inside the bit due to the abrasive mud flow. Another view of hardened metal mud blocking part 128 is shown that prevents wear due to the mud flow through main mud flow channel 130. The main mud flow channel 130 is connected to watercourse 164. The main mud flow channel 130 is also connected to watercourses 120 and 124 shown in FIG. 7, and to others shown in FIG. 9.

FIG. 8 also possesses lateral mud flow cavities that are sealed when the bit is new. Main mud flow channel 130 is connected to lateral mud flow compensation cavity 168 that is in turn connected to lateral mud flow compensation cavity 170. Lateral mud flow compensation cavity 170 terminates into its sealed end 172 when the bit is new. The wall thickness of the metal from the end of the cavity 172 to the outer portion of the drill bit is labeled with legend "P" in FIG. 8. As the bit undergoes lateral wear, eventually the dimension "P" is ground off the lateral wall of the drill bit. Eventually, the end of the cavity 172 opens to the hole. When that happens, mud flow squirts out laterally into the well. The cross sectional dimensions of the lateral mud flow compensation cavity 170 are chosen so that a controlled mud flow exits laterally out of the bit as the rotary bit rotates in the well. This extra mud flow will tend to increase the diameter or the gauge of the hole. This extra mud flow compensates for the lateral bit wear (that would otherwise cause the bit to drill a tapered hole). Such a channel that opens after lateral wear shall be defined herein as a "lateral mud flow compensation channel". When the bit undergoes lateral wear, the opening of the lateral mud flow compensation channel tends to produce a relatively constant gauge hole. Therefore, FIGS. 7 and 8 describe a monolithic drill bit possessing lateral compensation means to compensate for the lateral wear of the drill bit during drilling operations that tends to make a relatively constant gauge hole. Similarly, FIG. 8 shows that main mud flow channel 130 is connected to lateral mud flow compensation cavity 174 that is in turn connected to lateral mud flow compensation cavity 176. Lateral mud flow compensation cavity 176 terminates into its sealed end 178 when the bit is new. The wall thickness of the metal from the end of the cavity 178 to the outer portion of the drill bit is labeled with legend "Q" in FIG. 8. Also shown is the lateral bit protrusion on the right hand side of the bit along cross section "B"-"D" that is labeled as region 180 in FIG. 8.

FIG. 9 shows the bottom view of the preferred embodiments shown in FIGS. 7 and 8. FIG. 9 shows the orientations of the cross sections. FIG. 7 showed the cross section "A"-"C". FIG. 8 showed the cross section "B"-"D". Tungsten carbide rods 98, 100, 102, 106, 108, 110 and 112 have been identified in FIG. 7. Hardened metal scrapers 116 and 118 have been identified in FIG. 7. Watercourse 120 having hardened metal tube 122 and watercourse 124 were identified in FIG. 7. Tungsten carbide rods 144, 146, 148, 150, 152, 154, 156, 158, 160, and 162 have been identified in FIG. 8. Watercourse 164 was identified in FIG. 8. Additional hardened metal scrapers 182 and 184 are shown in FIG. 9. Recessed hardened metal scrapers 186 and 188 are shown in FIG. 9. Their outer edges are set back from the outer surface of the bit by a distance labeled with legend "J" in FIG. 9. Their outer edges becomes exposed upon the lateral wear of the bit. The process of additional exposure of the hardened metal scrapers provides additional lateral compensation means to compensate for lateral bit wear during drilling operations.

FIG. 9 shows additional watercourses 190 and 192 exiting from the bottom of the bit. Element 194 is a sealed end to another watercourse. The wall thickness of the material to enter that new watercourse is chosen to be some predetermined dimension (0.20 inches thick for example). Therefore, as the bit undergoes longitudinal wear, another water-passage opens up facing downward resulting in additional mud flow into the bottom of the well during drilling. This extra mud flow will tend to increase the drilling rate which therefore tends to compensate for longitudinal bit wear. Such a channel that opens after longitudinal bit wear shall be defined herein as a "longitudinal mud flow compensation channel". Therefore, FIGS. 7, 8, and 9 describe a monolithic rotary drill bit having longitudinal compensation means to compensate for the longitudinal wear of the drill bit during drilling operations.

FIG. 9 also has a square shaped tungsten carbide "rod" labeled as element 196. A triangular shaped tungsten carbide "rod" is identified as element 198 in FIG. 9. An elliptically shaped tungsten carbide "rod" is identified as element 200 in FIG. 9. An irregular shaped "rod" is identified as element 202 in FIG. 9. Larger O.D. rods are respectively identified as elements 204 and 206 in FIG. 9. The term "rod" has been used many times herein.

In this application, the term "rod" shall mean any physical item possessing a geometrical shape that is relatively long compared to any other dimension perpendicular to its length. If the "rod" has a cylindrical shape, then the rod shall have a length that is at least N times its diameter where the number N is defined to be the aspect ratio of the rod. N can be chosen to be equal to a predetermined number (not necessarily an integer). For example, the aspect ratio N can be chosen to be the number 3.0. In this case, the "rod" would have a length at least 3 times its diameter. If the "rod" has a rectangular shape, then the rod shall have a length that is at least N times any of the dimensions perpendicular to its length. If the "rod" has a hollow cylindrical shape, then the rod shall have a length that is at least N times its outside diameter regardless of the inside diameter of the hole through it. If the "rod" has an irregular shape such as element 202 in FIG. 9, then the meaning of "rod" shall mean that the length of the rod shall be equal to or exceed N times "the average dimension of the rod perpendicular to its length". As the bit turns, any type of hardened "rod" as defined above shall become gradually exposed as the relatively softer matrix material becomes exposed. The process of the gradual wearing of the steel alloy matrix material that exposes additional portions of the tungsten carbide rods is an example of a longitudinal compensation means that compensates for the longitudinal wear of the drill bit during drilling operations. Therefore, FIGS. 7, 8, and 9 describe a preferred embodiment of the invention that is a monolithic rotary drill bit having longitudinal compensation means to compensate for the longitudinal wear of the drill bit during drilling operations.

FIG. 9 also identifies junk slot 208 and junk slot 210 in the monolithic dill bit. For future reference, the "azimuthal angle" is that angle subtended from the center of the bit to a given direction in relation to the line from the center of the bit to the direction "C". However, for clarity, that angle is not identified in FIG. 9. Similarly, "the vector radius" shall mean the radius along any azimuthal angle to the outer boundary of the drill bit (that is not shown for simplicity).

The term "hardened rod" has been used many times herein. The term "hardened rod" shall be defined to include rods fabricated from tungsten carbide materials that are shaped into the form of a "rod" defined above. The term "hardened rod" shall also be defined to include any type of material having a rod shape possessing a hardness exceeding the hardness of the surrounding steel alloy matrix material.

The term "hardened steel scraper" has been used repeatedly herein. A hardened steel scraper as herein used is a long hardened steel object having a number of different shapes as described in the text. As defined above, the term "hardened rod" includes many objects that are described as "hardened steel scrapers". In general, any hardened metal scraper herein may be replaced with a suitably shaped piece of tungsten carbide material.

The term "matrix material" has been used herein. The term "matrix" material shall be defined to include any material that is made to surround the hardened rods that comprise the monolithic drill bits described herein. However, the term "matrix material" shall be defined to specifically include tungsten carbide binder alloys, any known steel alloy material, crushed or powdered or sintered tungsten carbide materials or other suitable materials, any type very tough ceramic material that can bind to any hardened rod, any type of very tough ceramic material that can be glued to any hardened rod, or any other type of suitable binder material of any type produced by any process that can mechanically hold and surround the hardened rods and otherwise handle the stresses typical of materials used in drill bits. The term "matrix material" shall be defined to be any material whatsoever that surrounds the hardened rods that comprise the monolithic drill bits described herein. For the purposes herein, the word "steel" and "steel alloy" can be used interchangeably and mean any type of steel made suitable for the purpose. While the term "steel alloy matrix material" has often been explicitly used, that term may be replaced anywhere in the text with simply "matrix material" to rigorously define the preferred embodiments of the invention herein.

All of the preferred embodiments described herein possess at least one hardened rod that is surrounded by matrix material that comprises the monolithic drill bit. If drill bits were instead fabricated having relatively short pieces of tungsten carbide materials cast into a steel matrix, then these relatively short pieces of tungsten carbide inserts could fall out of the bit into well as the drill bit wears thereby permanently damaging the drill bit. It would not matter if the relatively short pieces of tungsten carbide material were cylindrical shaped, rectangular shaped, or irregular in shape. Here, short can be operationally defined as follows. For any "short piece", determine the longest dimension of the "short piece" along its "length". Then determine "the average dimension of the short piece perpendicular to its length". Therefore, the definition of "short piece" herein shall mean that the short piece shall have a length that is less than N times the average dimension of the short piece perpendicular its length where N is the aspect ratio defined above. For example, the aspect ratio N can be chosen to be equal to the number 3.0. In this case, the short piece would have a length less than 3 times the average dimension perpendicular to its length. The advantage of the preferred embodiments disclosed herein is that as they wear in the well during drilling operations, the relatively long pieces of tungsten carbide rods do not tend to fall out of the bits into the well. Instead, the hardened rods tend to be supported by the matrix material until they are ground off during the wear of the bit during drilling operations.

It is necessary to further state that the preferred embodiments of the invention herein can undergo substantial longitudinal wear before the bit becomes unusable. In all cases, any of the preferred embodiments herein provide a bit that can wear down to less ½ its original overall length when new—and yet remain functional. The various lateral compensation means provide a bit that can undergo substantial lateral wear before the bit becomes unusable.

The terms "longitudinal compensation means" and "lateral compensation means" have been described herein. As used herein, these compensation means are passive, or "self-actuating", in that no external commands or controls are required from the surface to cause the desired compensation processes to occur. Instead, these processes naturally occur within the bit as the rotary bit undergoes wear during drilling operations. In other words, these compensation processes are "triggered by bit wear". Many other designs and physical principles of operation may be used to design different specific types of longitudinal compensation means to compensate for longitudinal bit wear and lateral compensation means to compensate for lateral bit wear. For example, certain pistons contained in hydraulic chambers may be used to implement changes in mud flow channels to implement longitudinal compensation means and lateral compensation means that are triggered by bit wear. Other physical processes can be used to alter mud flow to implement longitudinal compensation means and lateral compensation means that are triggered by bit wear. Any physical process that is triggered by bit wear that results in compensation for longitudinal bit wear and compensation for lateral bit wear is an embodiment of the invention herein. The preferred embodiments herein merely suggest certain types of longitudinal compensation means and lateral compensation means that are triggered by bit wear and the invention should not be limited to specific means described herein.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A monolithic long lasting rotary drill bit assembly for attachment to a rotary drill string for drilling a relatively constant diameter borehole into a geological formation comprising:

at least one tungsten carbide rod cast into a relatively soft steel matrix material to make at least a portion of the body of a drill bit, whereby said body of the drill bit has a top end, a bottom end, and a lateral extent, said top end of the drill bit being attached to said rotary drill string, said bottom end of the drill bit being in contact with the bottom of the borehole during rotary drilling, and a portion of said lateral extent of the body of the drill bit being in contact with a part of the wall of the borehole during rotary drilling, whereby during rotary drilling, the bottom end of the drill bit undergoes wear that progressively exposes new portions of the tungsten carbide rod whereby said rod has a length exceeding three times its diameter and whereby said rod wears and undergoes breakage as the relatively soft steel matrix material located at the bottom end of the drill bit erodes during rotary drilling operations thereby making the drill bit that self sharpens on the bottom of the drill bit during drilling operations;

means to compensate for the lateral wear of the drill bit that produces a relatively constant lateral extent of the body of the drill bit during drilling operations to make a drill bit that drills a relatively constant diameter borehole as the drill bit undergoes said lateral wear, whereby said means to compensate for the lateral wear of the drill bit is comprised of at least two pre-stressed mechanical means joined together to form the body of the monolithic drill bit that produce internal lateral stresses within the body of the drill bit whereby the body of the drill bit possesses a lateral flair in the lateral extent of the drill bit near the bottom of the drill bit and whereby said lateral flair expands radially as the bottom end of the drill bit erodes during rotary drilling operations in response to said internal lateral stresses;

at least one watercourse that conducts mud from the drill string to the borehole being drilled through at least one opening in the drill bit;

thereby providing a long lasting drill bit that self sharpens on the bottom end of the drill bit during drilling operations and that compensates for lateral wear of the drill bit to produce a relatively constant diameter borehole.

2. A monolithic long lasting rotary drill bit assembly for attachment to a rotary drill string for drilling a relatively constant diameter borehole into a geological formation comprising:

at least one tungsten carbide rod cast into a relatively soft steel alloy matrix material to make at least a portion of the body of a drill bit, whereby said body of the drill bit has a top end, a bottom end, and a lateral extent, said top end of the drill bit being attached to said rotary drill string, said bottom end of the drill bit being in contact with the bottom of the borehole during rotary drilling, and a portion of said lateral extent of the body of the drill bit being in contact with a part of the wall of the borehole during rotary drilling, whereby during rotary drilling, the bottom end of the drill bit undergoes wear that progressively exposes new portions of the tungsten carbide rod whereby said rod has a length exceeding three times its diameter and whereby said rod wears and undergoes breakage as the relatively soft steel matrix material located at the bottom end of the drill bit erodes during rotary drilling operations thereby making the drill bit that self sharpens on the bottom of the drill bit during drilling operations;

means to compensate for the lateral wear of the drill bit that produces a relatively constant lateral extent of the body of the drill bit during drilling operations to make a drill bit that drills a relatively constant diameter borehole as the drill bit undergoes said lateral wear, whereby said means to compensate for the lateral wear of the drill bit is comprised of selectively heat treated portions of the body of the drill bit that produce internal lateral stresses within the body of the drill bit whereby the body of the drill bit possesses a lateral flair in the lateral extent of the drill bit near the bottom of the drill bit and whereby said lateral flair expands radially as the bottom end of the drill bit erodes during rotary drilling operations in response to said internal lateral stresses;

at least one watercourse that conducts mud from the drill string to the borehole being drilled through at least one opening in the drill bit;

thereby providing a long lasting drill bit that self sharpens on the bottom end of the drill bit during drilling operations and that compensates for lateral wear of the drill bit to produce a relatively constant diameter borehole.

3. A monolithic long lasting rotary drill bit assembly for attachment to a rotary drill string for drilling a relatively constant diameter borehole into a geological formation comprising:

at least one tungsten carbide rod cast into a relatively soft steel alloy matrix material to make at least a portion of the body of a drill bit, whereby said body of the drill bit has a top end, a bottom end, and a lateral extent, said top end of the drill bit being attached to said rotary drill string, said bottom end of the drill bit being in contact with the bottom of the borehole during rotary drilling, and a portion of said lateral extent of the body of the drill bit being in contact with a part of the wall of the borehole during rotary drilling, whereby during rotary drilling, the bottom end of the drill bit undergoes wear that progressively exposes new portions of the tungsten carbide rod whereby said rod has a length exceeding three times its diameter and whereby said rod wears and undergoes breakage as the relatively soft steel matrix material located at the bottom end of the drill bit erodes during rotary drilling operations thereby making the drill bit that self sharpens on the bottom of the drill bit during drilling operations;

means to compensate for the lateral wear of the drill bit during drilling operations to make a drill bit that drills a relatively constant diameter borehole as the drill bit undergoes said lateral wear, whereby said means to compensate for the lateral wear of the drill bit is comprised of at least one hardened metal scraper facing radially outward and set-back from the lateral wall of the drill bit by a predetermined distance into the steel alloy matrix material of the body of the drill bit before drilling commences, whereby said hardened metal scraper becomes progressively exposed as the drill bit undergoes lateral wear so as to compensate for the lateral wear of the drill bit;

at least one watercourse that conducts mud from the drill string to the borehole being drilled through at least one opening in the drill bit;

thereby providing a long lasting drill bit that self sharpens on the bottom end of the drill bit during drilling operations and that compensates for lateral wear of the drill bit to produce a relatively constant diameter borehole.

4. A monolithic long lasting rotary drill bit assembly for attachment to a rotary drill string for drilling a relatively constant diameter borehole into a geological formation comprising:

at least one tungsten carbide rod cast into a relatively soft steel alloy matrix material to make at least a portion of the body of a drill bit, whereby said body of the drill bit has a top end, a bottom end, and a lateral extent, said top end of the drill bit being attached to said rotary drill string, said bottom end of the drill bit being in contact with the bottom of the borehole during rotary drilling, and a portion of said lateral extent of the body of the drill bit being in contact with a part of the wall of the borehole during rotary drilling, whereby during rotary drilling, the bottom end of the drill bit undergoes wear that progressively exposes new portions of the tungsten carbide rod whereby said rod has a length exceeding three times its diameter and whereby said rod wears and undergoes breakage as the relatively soft steel matrix material located at the bottom end of the drill bit erodes during rotary drilling operations thereby making the drill bit that self sharpens on the bottom of the drill bit during drilling operations;

means to compensate for the lateral wear of the drill bit during drilling operations to make a drill bit that drills a relatively constant diameter borehole as the drill bit undergoes said lateral wear, whereby said means to compensate for the lateral wear of the drill bit is comprised of at least one lateral mud flow compensation channel that is initially sealed when the drilling commences but which opens as the drill bit undergoes lateral wear causing mud to flow into the well in the lateral direction so as to compensate for the lateral wear of the drill bit;

at least one watercourse that conducts mud from the drill string to the borehole being drilled through at least one opening in the drill bit;

thereby providing a long lasting drill bit that self sharpens on the bottom end of the drill bit during drilling operations and that compensates for lateral wear of the drill bit to produce a relatively constant diameter borehole.

* * * * *